US008356952B2

(12) United States Patent
Bennett et al.

(10) Patent No.: US 8,356,952 B2
(45) Date of Patent: Jan. 22, 2013

(54) COMPACT CONTAINER FOR LIQUID COSMETIC

(75) Inventors: Kyle M. Bennett, Brown Deer, WI (US); Jill McCurdy, Milwaukee, WI (US)

(73) Assignee: Rexam Beauty and Closures, Inc., Sussex, WI (US)

( * ) Notice: Subject to any disclaimer, the term of this patent is extended or adjusted under 35 U.S.C. 154(b) by 944 days.

(21) Appl. No.: 12/353,660

(22) Filed: Jan. 14, 2009

(65) Prior Publication Data

US 2009/0202290 A1 Aug. 13, 2009

Related U.S. Application Data

(60) Provisional application No. 61/021,267, filed on Jan. 15, 2008, provisional application No. 61/052,043, filed on May 9, 2008.

(51) Int. Cl.
*B43K 23/08* (2006.01)

(52) U.S. Cl. ..... 401/213; 401/212; 401/216; 132/293

(58) Field of Classification Search ..... 401/212, 401/213, 215, 216; 132/293, 299, 301
See application file for complete search history.

(56) References Cited

U.S. PATENT DOCUMENTS 1,911,691 A * 5/1933 Jacobson ..... 132/299
5,526,960 A 6/1996 Breidenbach et al.
5,586,694 A 12/1996 Breidenbach et al.
5,896,866 A * 4/1999 Quennessen ..... 132/293
6,095,708 A 8/2000 Butaud
6,276,853 B1 8/2001 Breidenbach et al.
6,354,308 B1 * 3/2002 Kuk ..... 132/301
6,814,520 B1 * 11/2004 Delli Venneri et al. ..... 401/213
6,939,071 B1 9/2005 Breidenbach et al.
7,841,349 B2 * 11/2010 Bennett ..... 132/293
2004/0105716 A1 6/2004 Carlino
2004/0234321 A1 11/2004 Breidenbach et al.
2006/0245812 A1 11/2006 Carlino
2007/0071538 A1 3/2007 Doria
2008/0003052 A1 1/2008 Lee et al.
2008/0014011 A1 1/2008 Rossen

* cited by examiner

*Primary Examiner* — Tuan N Nguyen
(74) *Attorney, Agent, or Firm* — Middleton Reutlinger; Chad D. Bruggeman; John F. Salazar

(57) ABSTRACT

A container for supporting and dispensing a liquid material is disclosed. The container includes a base defining a cavity for supporting a liquid material and an applicator (e.g., a roller ball, etc.) movably supported at the base for allowing a user to selectively dispense the liquid material from the cavity. The applicator has a first portion and a second portion. The first portion is configured to be exposed to the liquid material when the second portion is exposed to the user. The container also includes a cover coupled to the base for covering the applicator. The cover is selectively movable between a closed position and an open position. The applicator is configured to be manipulated by user in a manner that allows the first portion to become exposed to the user and the second portion to become exposed to the liquid material.

21 Claims, 7 Drawing Sheets

COMPACT CONTAINER FOR LIQUID COSMETIC

CROSS REFERENCE TO RELATED PATENT APPLICATIONS

The present application claims the benefit of U.S. Provisional Application No. 61/021,267, having a filing date of Jan. 15, 2008, titled "Compact Container for Liquid Cosmetic," and U.S. Provisional Application No. 61/052,043, having a filing date of May 9, 2008, titled "Compact Container for Liquid Cosmetic," the complete disclosures of which are hereby incorporated by reference.

BACKGROUND

The present disclosure relates generally to a compact container configured to hold a liquid, gel or semi-liquid material, such as a cosmetic material. More specifically, the present disclosure relates to a compact container configured to support an applicator for dispensing the liquid, gel or semi-liquid material. The present disclosure also relates to methods of manufacturing such compact containers.

Cosmetic materials (e.g., lip glosses, foundation, concealer, lipstick, lotions, etc.) are often applied and/or dispensed using an applicator. Applicators (e.g., wands, brushes, pads, sponges, etc.) are sometimes supported within the compact container when the compact container is being stowed, but are generally configured to be removed by a user in order to apply and/or dispense the cosmetic material. Providing an applicator that is removable from the compact container may increase the likelihood that the applicator will become contaminated or lost. Further, a user may have difficulty trying to hold the compact container with one hand while using the applicator with a second hand.

Thus, there is need for an improved container for holding and dispensing a liquid, gel or semi-liquid material, and particularly, a cosmetic material in such form.

SUMMARY

One embodiment relates to a container for supporting and dispensing a liquid material. The container includes a base defining a cavity for supporting a liquid material and an applicator movably supported at the base for allowing a user to selectively dispense the liquid material from the cavity. The applicator has a first portion and a second portion. The first portion is configured to be exposed to the liquid material when the second portion is exposed to the user. The container also includes a cover coupled to the base for covering the applicator. The cover is selectively movable between a closed position and an open position. The applicator is configured to be manipulated by user in a manner that allows the first portion to become exposed to the user and the second portion to become exposed to the liquid material.

Another embodiment relates to a method of manufacturing a container configured to retain a liquid material. The method includes the step of providing a base having a cavity configured to retain the liquid material. The base has a deck defining an aperture through which the liquid material is configured to be dispensed. The method also includes supporting an applicator within the aperture so that the applicator can rotate within the aperture while remaining fixed to the base. The applicator is provided for allowing a user to selectively retrieve the liquid material from the cavity. The method further includes coupling a cover to the base. The cover is movable between a closed position and an open position relative to the base.

Another embodiment relates to a cosmetic compact for retaining a liquid material. The compact includes a base having a cavity configured to retain the liquid material. The cavity is at least partially defined by an upper deck. The deck has a dispensing aperture in communication with the cavity. The compact also includes a cover pivotally coupled to the base and an applicator coupled to the deck and supported for rotatable movement within the dispensing aperture. Rotation of the applicator is configured to provide for removal of the liquid material from the cavity.

DETAILED DESCRIPTION

Figure 1:
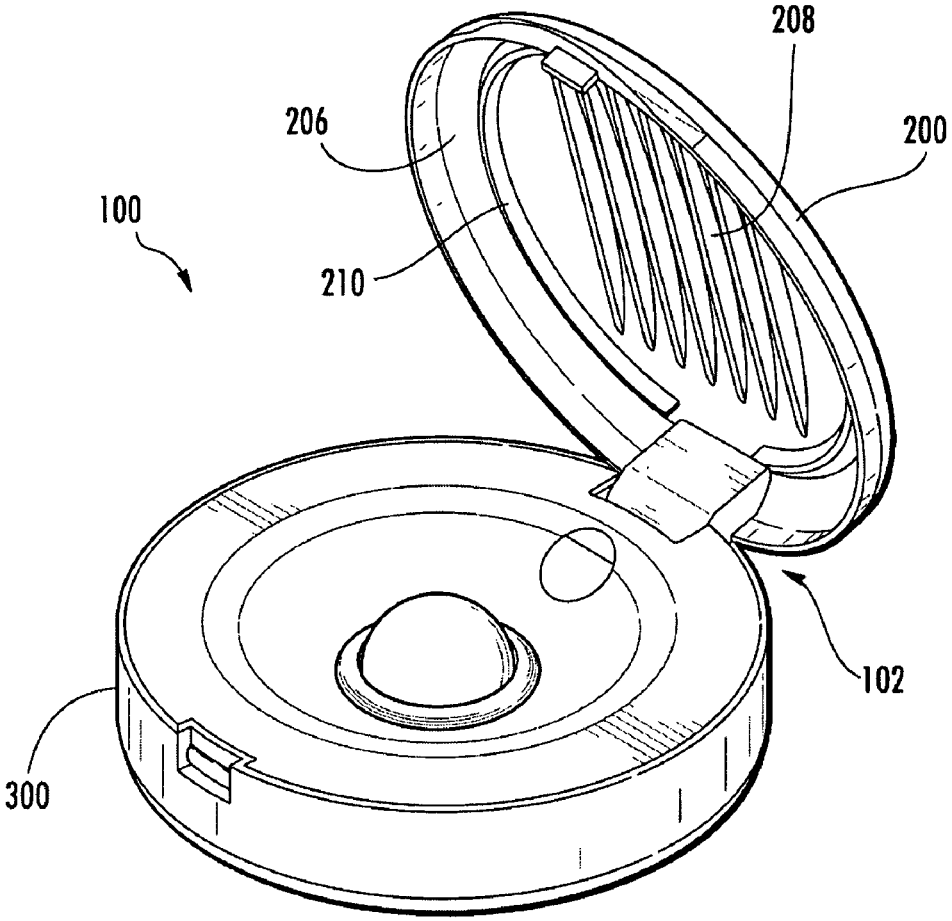
FIG. 1 is a top perspective view of a container according an exemplary embodiment shown in an open position.
Figure 2:
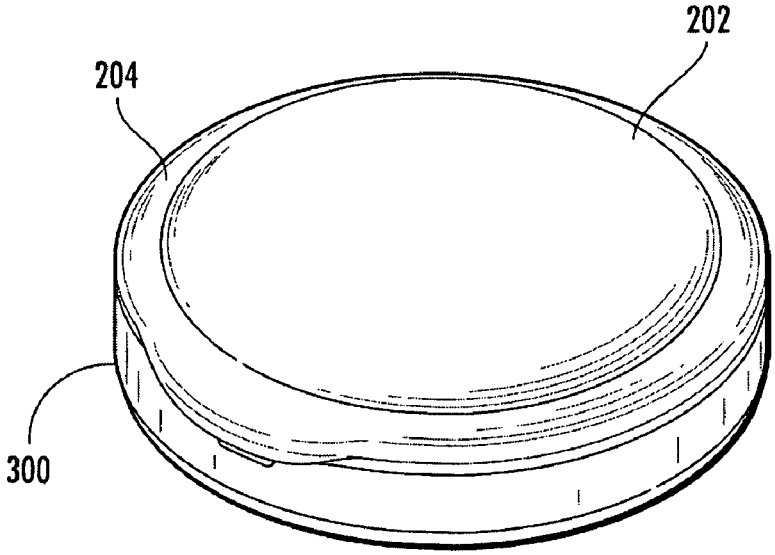
FIG. 2 is a perspective view of the container of FIG. 1 shown in a closed position.
Figure 3:
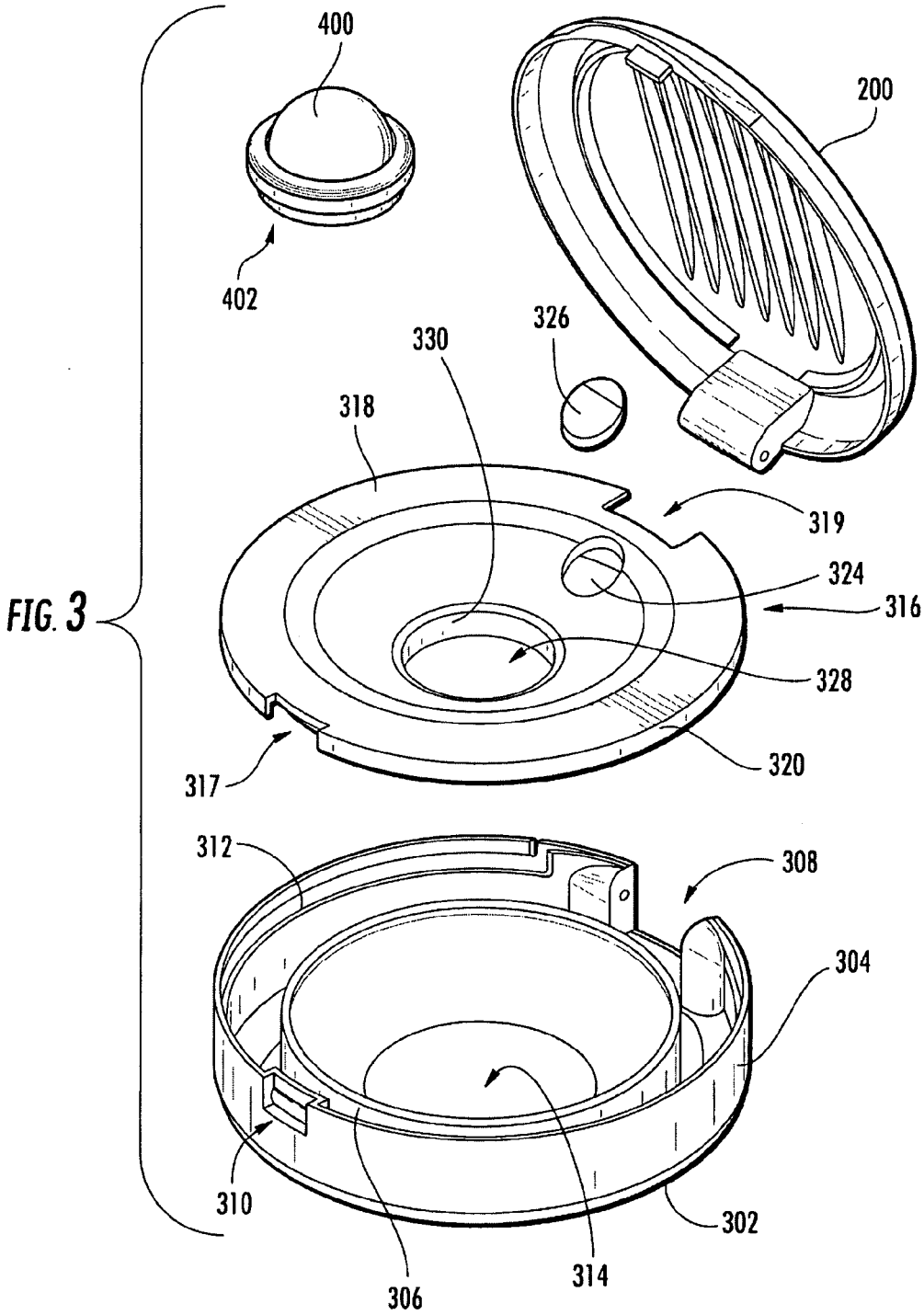
FIG. 3 is a partially exploded view of the container of FIG. 1

Referring generally to the FIGURES, a container and components thereof are shown according to an exemplary embodiment. The container is configured to retain and selectively dispense a liquid material. For purposes of the present disclosure, the term "liquid material" is used broadly to refer to any non-solid substance including, but not limited to, a gel, semi-liquid or semi-solid. The term liquid material is intended to cover substances including those with a relatively high viscosity (e.g., gels, etc.), those with a relatively low viscosity (e.g., water, etc.) and anything in between. The liquid material may be substantially homogeneous, or may have particles, including solid particles, suspended or otherwise contained therein.

The container may be a cosmetic container for holding a liquid cosmetic material (e.g., lip gloss, eye liner, mascara, nail polish, cover-up, foundation, concealer, lotion or other beauty aid, etc.). For purposes of the present disclosure, the term "cosmetic material" is used broadly to refer to any material which can be applied topically to the skin or other area on the user. Such materials include, but are not limited to, materials designed alter, conceal or enhance appearance or odor of the user and materials that provide a topical (e.g., skin, etc.) treatment or protection for the user. According to the various alternative embodiments, the container may also be used in any of a variety of non-cosmetic applications (e.g., to support a cleaning material, a medicinal material, etc.).

The container generally includes a first portion or base (e.g., receptacle, body portion, bottom, pan, storage well, etc.), a second portion or cover (e.g., closure, lid, top, etc.) and a third portion or applicator (e.g., dispensing device, roller ball, etc.). The base, cover and applicator cooperate to provide a conveniently sized storage system suitable for supporting and/or dispensing the liquid material. The container may also include a retention device (e.g. latch, locking mechanism, etc.) for selectively securing the cover to the base and/or a seal (e.g., hermetic seal, etc.) to assist in prolonging the freshness of the liquid material retained within the container.

The liquid material is stored within a cavity (e.g., reservoir, chamber, etc.) that is at least partially defined by or otherwise within the base. According to an exemplary embodiment, the base includes a first or upper surface (e.g., deck, platform, etc.) and a second or bottom surface. The upper surface defines one or more apertures or dispensing openings through which the liquid material retained in the cavity can be retrieved by the user. Supported at and/or at least partially within the dispensing opening is the applicator. Manipulation of the applicator by the user allows for the dispensing of the liquid material retained within cavity.

According to an exemplary embodiment, the applicator is a member that is rotatably supported within the dispensing aperture. For example, the member may be a substantially spherical member (e.g., ball, roller ball, etc.). The member is supported in such a way that one portion (e.g., side, etc.) of the member is accessible or otherwise exposed to the user while a second portion of the member is exposed to the liquid material retained within the cavity. The liquid material is collected on the outer surface of the second portion of the member and/or at least partially absorbed by such surface. To retrieve the liquid material in such an embodiment, the user can manipulate (e.g., rotate, turn, spin, etc.), the member relative to the base with his or her finger or other object so that the portion of the member that was previously exposed to the liquid material is now exposed to the user and the portion that was previously exposed to the user is now exposed to the liquid material.

When a user desires to use (e.g., apply, etc.) the liquid material stowed within the container, the user selectively moves (e.g., pivots, etc.) the cover into an open position relative to the base. According to an exemplary embodiment, the cover remains secured to the base while in the open position. For example, the container may have a clam-like configuration wherein the cover is pivotally coupled to the base about a hinge. Such a configuration advantageously allows a user to use one hand to conveniently hold and support the container in an open position and a second hand to manipulate the applicator for applying to contents. When the container is not in use, the applicator may also at least partially restrict the flow of the liquid material from the cavity by functioning as a stopper or valve to prevent or reduce the amount of the liquid material spreading to other portions of the container.

Referring to FIGS. 1 through 7, the container, shown as a compact container 100, is shown according to a first exemplary embodiment. Container 100 generally includes a cover 200, a base 300, and an applicator 400. Container 100 is configured to be selectively moved between a first or open position (shown in FIG. 1) and a second or closed position (shown in FIG. 2).

According to an exemplary embodiment, cover 200 includes an end wall 202 (e.g., platform, top, etc.) having a first or top surface 204 and a second or bottom surface 206. According to the embodiment illustrated, cover 200 is substantially circular in shape with top surface 204 having a slight curvature to provide a dome-like cover. Bottom surface 202 is shown as including one or more projections or stiffening ribs 208 for providing rigidity to cover 200 and one or more projections or segments 210 for supporting a mirror for use by a user when container 100 is in the open position. According to the various alternative embodiments, cover 200 may have any of a variety of shapes (e.g., rectangular, triangular, octagonal, etc.) and/or any of a variety of configurations (e.g., a substantially flat top surface, one or more side walls or skirts, etc.).

Base 300 is configured to correspond with cover 200 and be coupled thereto. It should be noted that for purposes of this disclosure, the term "coupled" is used broadly to mean the joining or combining of two or more members (e.g., portions, materials, components, etc.) directly or indirectly to one another. Such joining or combining may be relatively stationary (e.g., fixed, etc.) in nature or movable (e.g., adjustable, etc.) in nature. Such joining or combining may be achieved with the two members or the two members and any additional intermediate members being integrally formed as a single unitary body with one another (e.g., one-piece, etc.) or with the two members or the two members and any additional intermediate member being attached to one another. Such joining or combining may be intended to be relatively permanent in nature or alternatively may be intended to be relatively detachable or removable in nature.

Base 300 and cover 200 may be configured to be independent from each other when in the open position or may be configured to be fixedly coupled to each other when in the open position. The term "independent" as used herein is intended to describe a configuration wherein when container 100 is in the open position, cover 200 is not attached (directly or indirectly) to base 300. Accordingly, the term "fixedly coupled" as used herein is intended to describe a configuration wherein when compact is in the open position, cover 200 is intended to remain at least partially attached (directly or indirectly) to base 300.

According to the embodiment illustrated, base 300 is fixedly coupled to cover 200 about a hinge 102 that provides for the pivotal movement of cover 200 relative to base 300 between the open position and the closed position. Hinge 102 may have any of a variety of known or otherwise suitable configurations. According to the embodiment illustrated, hinge 102 includes a pivot shaft or rod that is received within corresponding opening in cover 200 and base 300 and that defines a pivot axis 104 about which cover 200 is configured to rotate between the open position and the closed position. According to the various alternative embodiments, hinge 102 may be provided by a butterfly-type hinge, a living hinge or by any other suitable hinge device.

According to an exemplary embodiment, base 300 includes an end wall 302 (e.g., platform, bottom, bottom surface, etc.), a first or outer wall 304 and a second or inner wall 306. Outer wall 304 is a generally cylindrical structure that includes a first end that is coupled to end wall 302 and a second, open end that is configured to receive a portion of cover 200. According to an exemplary embodiment, outer wall 304 includes an opening or cutout 308 in a rear portion that is configured to accommodate hinge 102. Outer wall 304 also includes an indentation or recess 310 provided in a front portion that is configured to accommodate a latch or locking device used for retaining cover 200 in the closed position. Outer wall 304 further includes a shelf or ledge 312 provided on an inner surface of outer wall 304. Ledge 312 is offset from the second end of outer wall 304 and is configured to support a top surface or deck of base 300.

Inner wall 306 (e.g., projection, ring, etc.) is a generally cylindrical structure that includes a first end that is coupled to end wall 302 and a second, open end. According to an exemplary embodiment inner wall 306 is a substantially continuous structure that is generally concentric with outer wall 304. Inner wall 306 cooperates with end wall 302 to define an aperture (e.g., reservoir, chamber, etc.), shown as a cavity 314, suitable for retaining the liquid material.

The size and shape of cavity 314 may vary depending on a number of design criteria. According to an exemplary embodiment, cavity 314 has a volume between approximately 1.5 cubic inches and approximately 8 cubic inches. According to various alternative embodiments, cavity 314 may have a volume greater than or less than the range provided. Limiting the volume of cavity 314 allows the overall size of compact 100 to be minimized, thereby allowing compact 100 to be conveniently carried or stowed in relatively size restricted areas (e.g., pockets, purses, backpacks, etc.) by the user.

To at least partially close off and/or conceal cavity 314, base 300 also includes a top surface (e.g., platform, etc.), shown as a deck 316. According to an exemplary embodiment, deck 316 is a separate member having shape that corresponds to outer wall 304. Deck includes a first opening or cutout portion 317 configured to accommodate recess 310 and a second opening or cutout portion 319 configured to accommodate hinge 102. Deck 316 also includes an end wall 318 that is substantially flat or planar around its outer periphery and then moves downwardly and inwardly (e.g., in a continuously curved, concave manner, etc.) towards a central region. The downwardly and inwardly extending contour of the central portion of deck 316 may advantageously ensure that applicator 400 is positioned within the liquid material retained within cavity 314. Such a contour may also advantageously direct or otherwise bias excess liquid material spilled onto deck 316 towards applicator 400.

Extending downward from the outer planar portion of end wall 318 is a first or outer skirt 320 and a second or inner skirt 322. A bottom surface of outer skirt 320 is configured to be received by or nest with ledge 312 while inner skirt 322 is configured to engage inner wall 306 to provide a seal for cavity 314. According to an exemplary embodiment, outer skirt 320 is attached at ledge 312 via an adhesive, a welding operation, a friction-fit, an interference fit or via any other technique suitable for securing outer skirt 320 to outer wall 304. Inner skirt 322 may be secured to inner wall 306 using any of the same techniques. According to an exemplary embodiment, inner skirt 322 may be a relatively flexible member having an inner diameter that is the same or slightly smaller than an outer diameter of inner wall 306. In such a configuration, inner skirt 322 may function as a flap or wiper to provide a seal (e.g., a hermetic seal, etc.) between inner skirt 322 and inner wall 306.

To facilitate the loading or filling of cavity 314 with the liquid material, end wall 318 defines an aperture or loading opening 324. According to an exemplary embodiment, loading opening 324 is located on the downwardly and inwardly extending portion of end wall 318 between dispensing opening 328 and hinge 102. After cavity 314 is filled with the liquid material, a stopper or plug 326 is disposed over loading opening 324 to substantially seal off the opening. According to an exemplary embodiment, plug 326 is a separate member that is coupled to end wall 318 after the liquid material is loaded into cavity 314. Plug 326 may be made of the same material as the rest of base 300 or may be made of a different material. According to an exemplary embodiment, plug 326 is intended to be permanently coupled to end wall 318 after the loading process (e.g., using a welding operation, mechanical fasteners, snap-fit, press-fit, adhesives, etc.). According to the various alternative embodiments, plug 326 may be removably coupled to end wall 318. According to the embodiment illustrated, plug 326 is configured to substantially conform to the contour of end wall 318 when coupled thereto to provide the appearance of a generally uniform and continuous top surface.

According to the embodiment illustrated, the central portion of end wall 318 defines an aperture or dispensing opening 328 through which the liquid material retained within cavity 314 is configured to be removed from cavity 314. As such, dispensing opening 328 provides a conduit for the liquid material between cavity 314 and the user. According to an exemplary embodiment, dispensing opening 328 is substantially circular in shape, but according to the various alternative embodiments, may have any of a number of shapes. Extending downward from end wall 318 around the periphery of dispensing opening 328 is a projection or rim 330. According to the embodiment illustrated, rim 330 is a substantially cylindrical structure extending continuously around dispensing opening 328.

Supported at least partially within dispensing opening 328 is applicator 400. Applicator 400 is supported such that a first portion of applicator 400 is within cavity 314 (and preferably in contact with the liquid material retained therein) and a second portion of applicator 400 is extending outward from deck 316. According to an exemplary embodiment, applicator 400 is sized so that the liquid material must first engage and/or be carried by applicator 400 when passing from cavity 314 to the user. According to the embodiment illustrated, applicator is a substantially spherical member (e.g., a ball, roller ball, etc.) configured to be rotatably supported within dispensing opening 328. In such an embodiment, applicator 400 is capable of being manipulated (e.g., rotated, turned, spun, etc.) in any direction relative to base 300 while having a portion of applicator remain within cavity 314.

Figure 4:
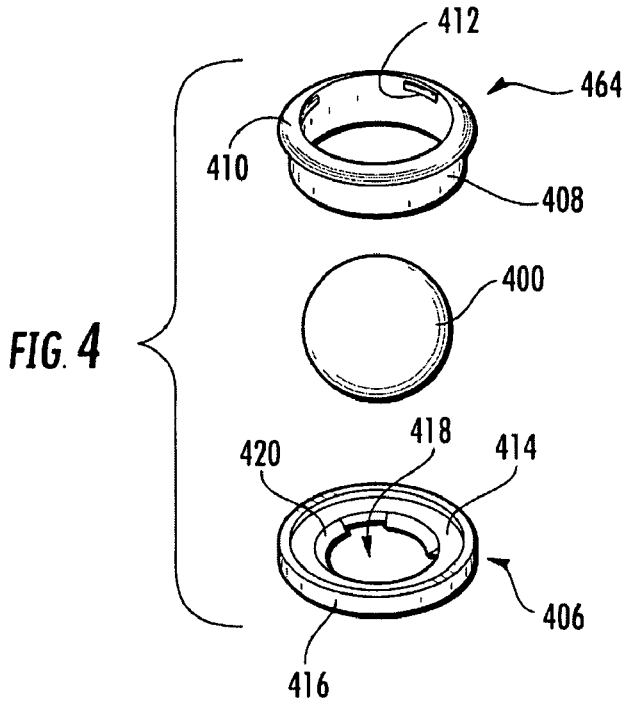
FIG. 4 is an exploded view of an applicator support assembly of the container of FIG. 1 according to an exemplary embodiment.

To support applicator 400 within dispensing opening 328, an applicator support assembly 402 is provided. Referring to FIG. 4 in particular, applicator support assembly 402 includes a first member or collar 404 and a second member or collar 406. First collar 404 includes a substantially cylindrical wall 408 that includes a projection or lip 410 extending around its upper edge. Provided on an inside surface of wall 408 are one or more projections or retaining tabs 412 for engaging applicator 400. Second collar 406 includes an end wall 414 having an upwardly extending wall 416 and defining a central opening 418. Provided around the periphery of opening 418 are one or more projections or retaining tabs 420, similar to retaining tabs 412. According to an exemplary embodiment, retaining tabs 410 and 412 cooperate to capture applicator 400 while still allowing enough space (e.g., a slight gap, etc.) between an outer surface of applicator 400 and the rest of applicator support assembly 402 for allowing the liquid material to pass through applicator support assembly 402 while being carried by applicator 400.

Figure 5:
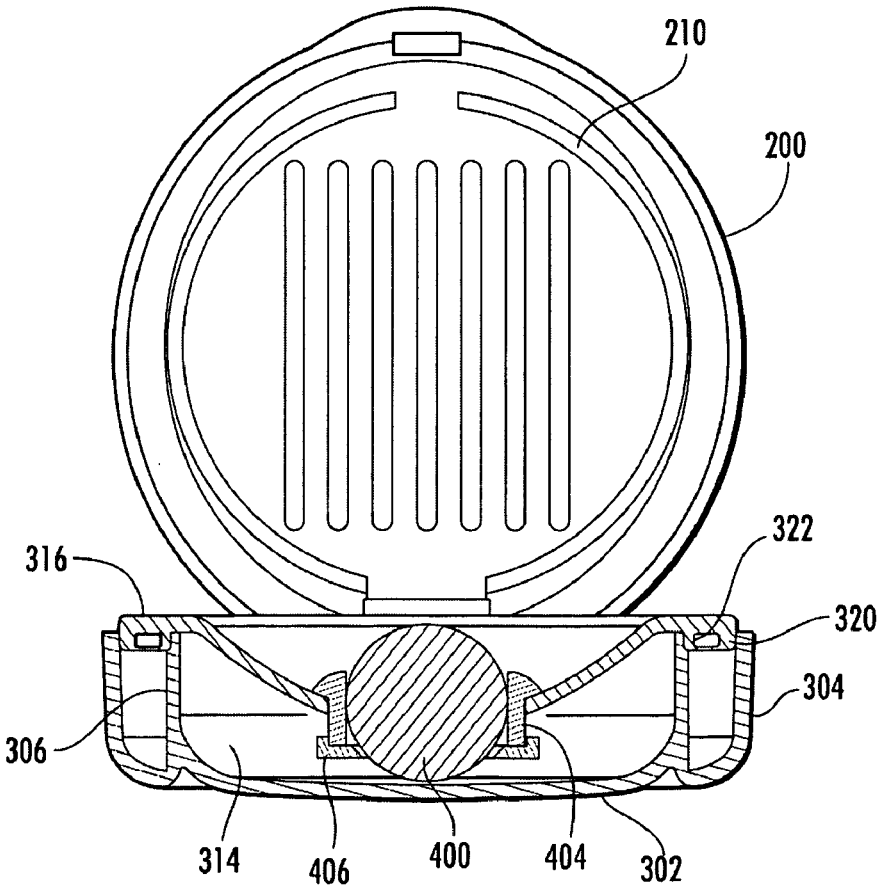
FIG. 5 is a front cross sectional view of the container of FIG. 1.
Figure 6:
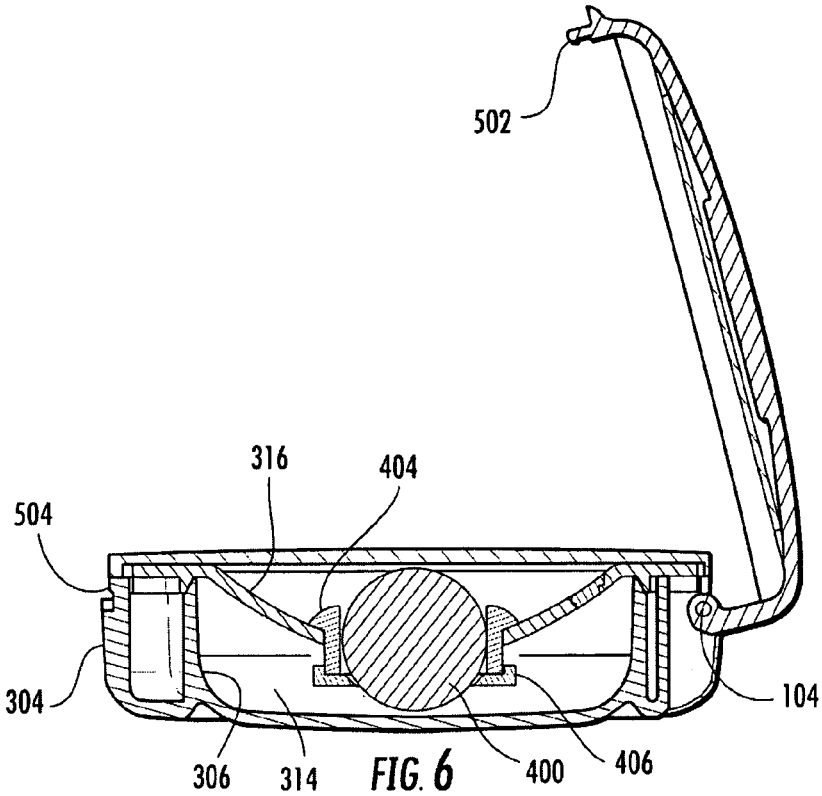
FIG. 6 is a side cross sectional view of the container of FIG. 1.
Figure 7:
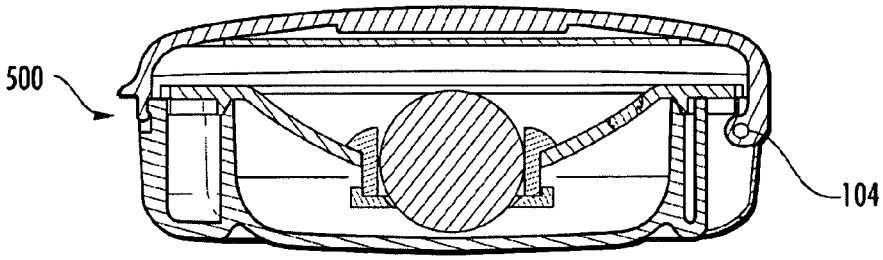
FIG. 7 is a side cross sectional view of the container of FIG. 2.

Referring to FIGS. 5 and 6, first collar 404 is positioned over the top of applicator 400 and is then inserted into dispensing opening 328 until lip 410 engages end wall 318. Second collar 406 is positioned under the bottom of applicator 400 with wall 416 extending over wall 408. According to an exemplary embodiment, the fit between first collar 404, second collar 406 and/or deck 316 secures applicator 400 to base 300 in a rotatable manner. According to the various alternative embodiments, applicator 400 can be held in place and rotate upon an axel or pins. According to further alternative embodiments, applicator 400 can be configured as any type of rotatable applicator. For example, applicator 400 can be shaped in variety of forms including as a cylinder, a barrel, an egg-shaped structure, or prism structure etc.

Applicator 400 provides a user with a tool that the user can use to retrieve the liquid material stored within cavity 314. According to an exemplary embodiment, applicator 400 is a solid member that may be constructed of any suitable material that substantially maintains its integrity (e.g., shape, size, etc.) when exposed to the liquid material and will provide an appropriate medium for delivering the liquid material to the user. For example, depending on the application, applicator 400 may be formed of an absorbent material, a non-absorbent material or anything in between. According to the various alternative embodiments, applicator 400 may be formed of one or more layers of materials (e.g., with different layers providing different features, etc.) and/or may be at least partially hollowed. According to still further alternative embodiments, applicator 400 and container 100 may be configured to dispense solid materials such as powdered materials.

According an exemplary embodiment, container 100 also includes a retaining device or locking mechanism, shown as a latch 500, to selectively secure cover 200 in the closed position relative to base 300. According to the embodiment illustrated, latch 500 includes a first latching element 502 located on cover 200 and a second latching element 504 located on base 300, first latching element 502 being one of a recess and a projection, while second latching element 504 is the other of the recess and the projection. When first latching element 502 is engaged with second latching element 504 (i.e., when container 100 is in the closed position), cover 200 and base 300 are sufficiently close to provide a seal for at least partially retaining moisture within container 100.

Container 100, via the assistance of latch 500, is configured to remain in the closed position when not in use. In the closed position, the user may choose to place container 100 in a purse, bag, pocket, etc. for use at various times. As container 100 and its contents (e.g., the liquid material, etc.) move around in a purse, bag, or pocket, etc. of the user, applicator 400 and any seals provided between cover 200, base 300 and/or applicator 400 substantially retain the liquid material within cavity 314 and/or within the boundaries of container 100. According to an exemplary embodiment, the size and material of applicator 400 provides a stop means or gate that substantially prevents the liquid material from leaking from cavity 314 into other areas of container 100.

When the user desires to access the liquid material from cavity 314, the user lifts up on cover 200 (e.g., on a tab 212, etc.) to release cover 200 from base 300 and pivot cover 200 into the open position. In the open position, the user accessing the liquid material by manipulating applicator 400. For example, the user may use his or her finger to rotate (e.g., turn, spin, etc.) applicator 400 within applicator support assembly 402 and relative to base 300. As applicator 400 rotates it moves the liquid material that was on applicator 400 in cavity 314 to a position wherein the liquid material is exposed to the user. The user may than apply the liquid material to his or her face or any other area where application of the liquid material is desirable. Once finished, the user may return container 100 to the closed position by moving cover 200 downwards relative to base 300 until first latching element 502 engages second latching element 504 to retain cover 200 in the closed position.

Figure 8:
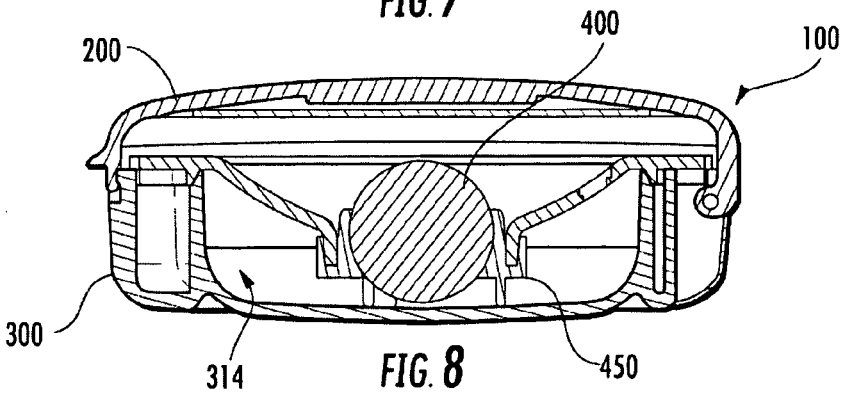
FIG. 8 is a side cross sectional view of a container according to another exemplary embodiment.
Figure 9:
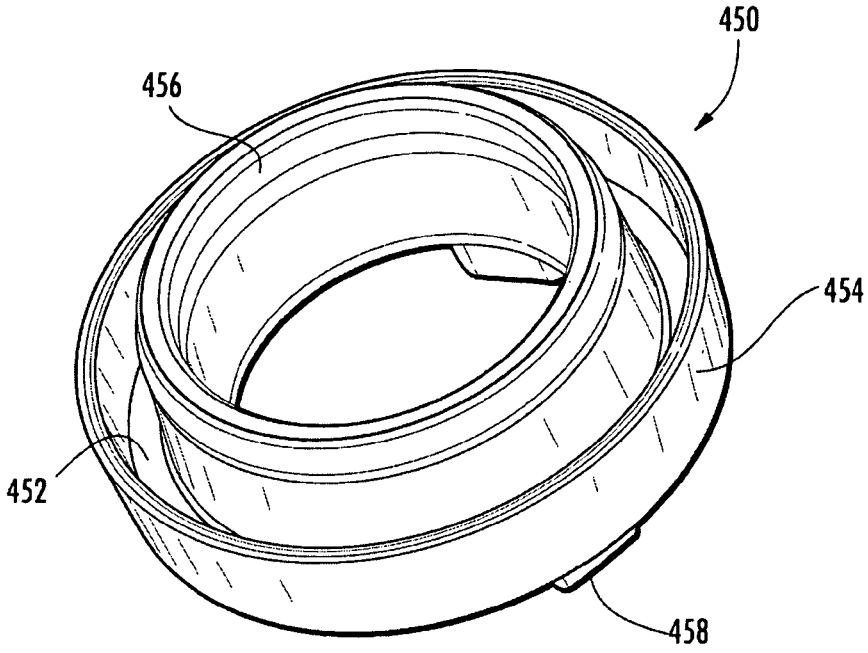
FIG. 9 is a top perspective view of an applicator support member of the container of FIG. 8 according to an exemplary embodiment.
Figure 10:
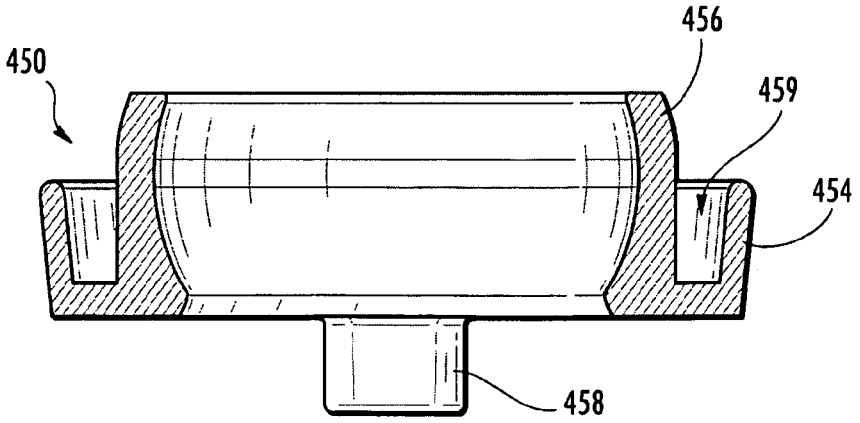
FIG. 10 is a side cross sectional view of the applicator support member of FIG. 9.
Figure 11:
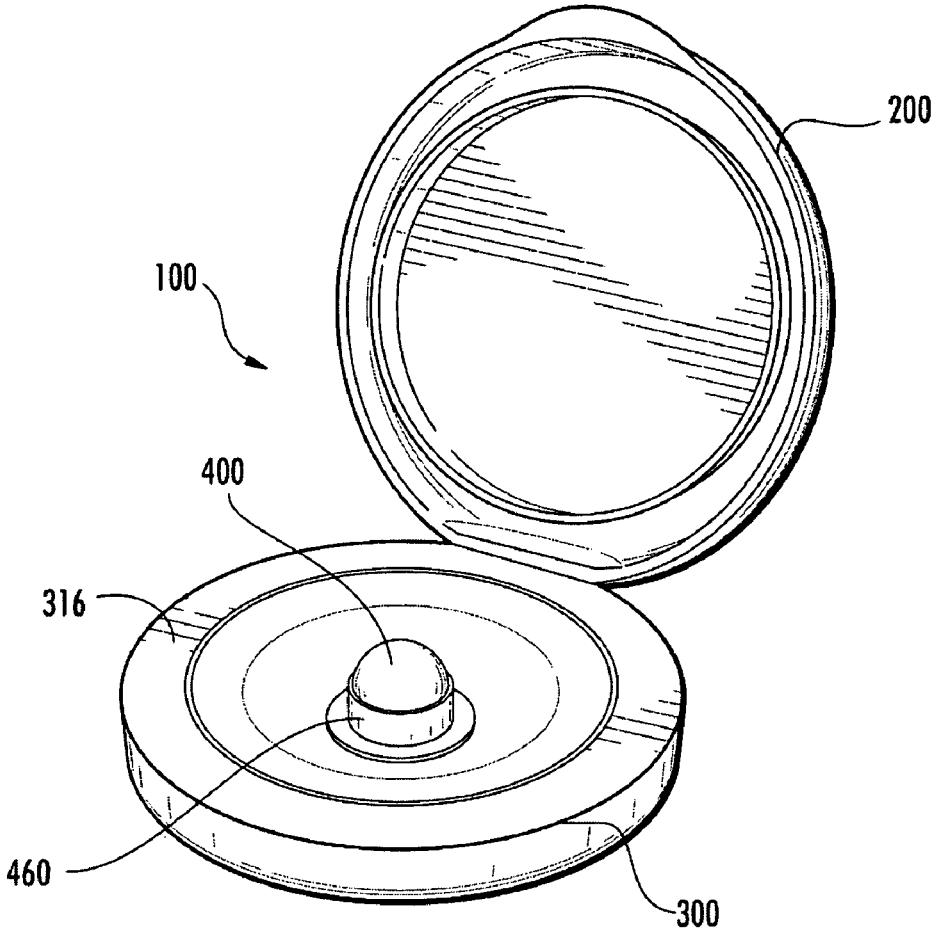
FIG. 11 is a top perspective view of a container according another exemplary embodiment shown in an open position.

Referring to FIGS. 8 through 10, a container 100 is shown according to a second exemplary embodiment. Container 100 of FIGS. 8 through 10 is similar to container 100 of FIGS. 1 through 7. A difference between the exemplary embodiments is the way in which applicator 400 is secured to base 300. According to the exemplary embodiment illustrated in FIGS. 8 through 10, container 100 includes a one-piece member, shown as an applicator support member 450, to secure applicator 400 to base 300.

Referring to FIGS. 9 and 10 in particular, applicator support member 450 includes an end wall 452, a first or outer wall 454, a second or inner wall 456 and one or more support members or feet 458. Applicator 400 is configured to be supported within an opening defined by an inside surface of inner wall 456. According to an exemplary embodiment, the inside surface of inner wall 456 has a contour that corresponds to the shape of applicator 400.

To secure applicator support member 450 to base 300, end wall 452, outer wall 454 and inner wall 456 cooperate to define a channel 458 configured to receive rim 330 of deck 316. Applicator support member 450 may be coupled to rim 330 using a welding operation, mechanical fasteners, snap-fit, press-fit, adhesives or any other suitable technique. To offset applicator 400 from end wall 302 of base 300, support feet 458 extend downward from end wall 452 and engage end wall 302. According to the embodiment illustrated, applicator 400 is supported relatively close to end wall 302 so that applicator 400 will still be exposed to the liquid material even when cavity 314 is almost depleted of the liquid material Referring to FIGS. 12 through 14, a container 100 is shown according to a third exemplary embodiment. Container 100 of FIGS. 11 through 14 is similar to containers 100 of FIGS. 1 through 10. A difference between the exemplary embodiments is that in the exemplary embodiment illustrated in FIGS. 11 through 14, cover 200 and base 300 are integrally formed as a one-piece unitary body. In such an embodiment, container 100 is molded as a substantially one-piece body via a suitable molding process (e.g., injection molding, etc.). According to the various alternative embodiments, container 100 may have a similar configuration but be formed as a variety of separate components.

Figure 12:
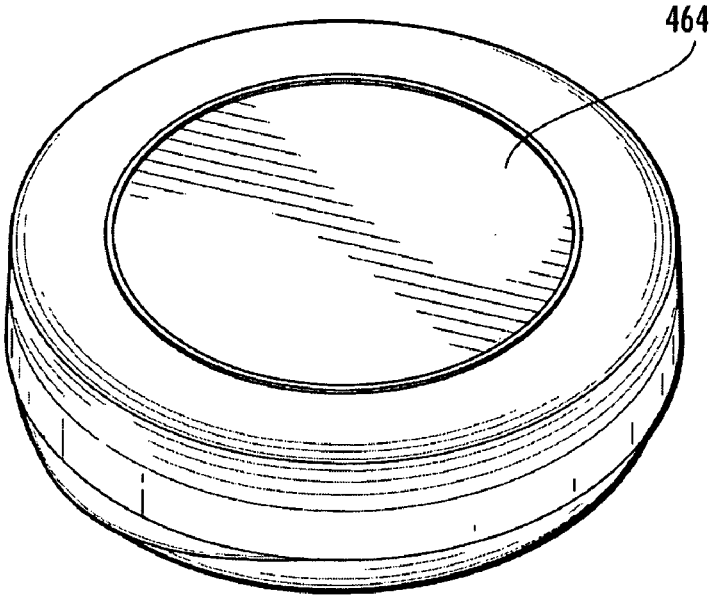
FIG. 12 is a bottom perspective view of the container of FIG. 11.
Figure 13:
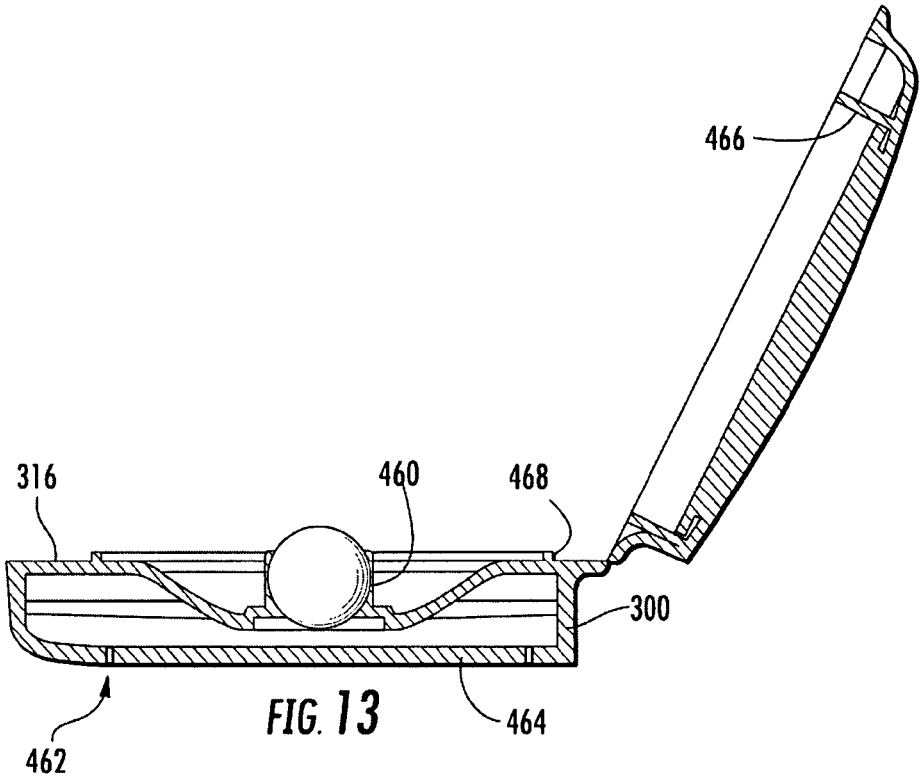
FIG. 13 is a side cross sectional view of the container of FIG. 11 shown in the open position.
Figure 14:
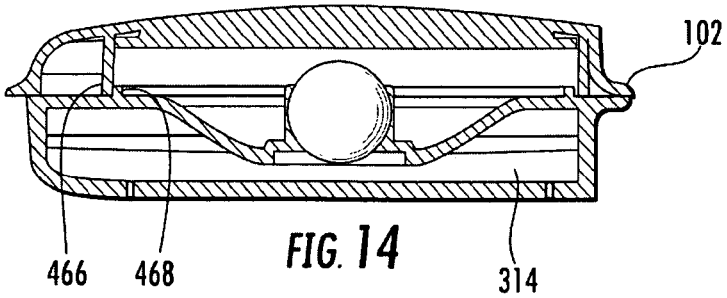
FIG. 14 is a side cross sectional view of the container of FIG. 11 shown in a closed position.

Referring to FIGS. 12 and 13 in particular, cover 200 is shown as being integrally formed as a one-piece member with base 300 at hinge 102, which in such an embodiment is a living hinge. Further, deck 316 is shown as being integrally formed as a one-piece member with outer wall 304 of base 300. In such an embodiment, base 300 includes a support structure, shown as a sleeve 460, extending outward from a central region of end wall 318 at a somewhat lowered or recessed area of end wall 318. Sleeve 460 is configured to receive and rotatably support applicator 400 in a manner similar to applicator support member 450.

According to the exemplary embodiment illustrated in FIGS. 11 through 14, container 100 is configured to be filled (e.g., loaded, etc.) with the liquid material from the bottom of base 300 ("bottom-loaded"). To facilitate filling container 100 in such a manner, base 300 includes an aperture 462 in end wall 302 that allows cavity 314 to be loaded with the liquid material from the bottom of base 300. After compact 100 is filled, a stopper or plug 464 is disposed over aperture 462 to substantially seal off the aperture. According to an exemplary embodiment, plug 464 is a separate member that is coupled to end wall 302 after the liquid material is loaded into cavity 314. Plug 464 may be made of the same material as the rest of base 300 and/or cover 200, or may be made of a different material. According to an exemplary embodiment, plug 464 is intended to be permanently coupled to end wall 302 after the filling process using a welding operation (e.g., conduction, induction, ultrasonically welded, etc.) or using any other suitable fastening means including, but not limited to, mechanical fasteners, snap-fit, adhesives, heat staking, etc. According to the various alternative embodiments, plug 464 may be removably coupled to end wall 302.

According to the exemplary embodiment illustrated in FIGS. 11 through 14, container 100 is configured to provide a hermetically sealed environment for the liquid material when in the container is in the closed position. The hermetic seal may prevent evaporation and/or contamination of the liquid material. As such, the hermetic seal may prolong the useful life of the liquid material stowed within container 100. For purposes of the present disclosure, the terms "hermetic" and "hermetically" refer to a seal configured to minimize fluid loss and configured to prolong the integrity of the article contained therein. The hermetic seal may be an airtight or substantially airtight seal. For example, a substantially airtight seal may include a seal that retains at least 80 percent water weight over 28 days at 50 degrees Celsius and 60 percent relative humidity.

To establish a hermetically sealed environment, a hermetic seal is provided between cover 200 and base 300. According to the embodiment illustrated, container 100 includes a retention device, shown as a first connector 466 and a second connector 468 for providing a hermetically sealed environment. First connector 466 is provided at cover 200, while second connector 468 is provided at base 300.

First connector 466 is shown as a first annular rim or projection that extends downward from bottom surface end wall 202 of cover 200. According to the embodiment illustrated, first connector 466 is shown as a continuous annular rim, but according to the various alternative embodiments, first connector 466 may be segmented or provided intermittently. According to an exemplary embodiment, first connector 466 extends downward at an orientation intended to facilitate a hermetic seal with second connector 250. For example, first connector 466 may extend at least partially inward as first connector 466 extends downward. First connector 466 is at least partially deformable (e.g., flexible, elastic, bendable, etc.) for biasing first connector 466 into a hermetically sealed position relative to second connector 468.

Second connector 468 is in the form of a second annular rim or projection that extends upward from upper surface of end wall 318 of deck 316. According to the embodiment illustrated, second connector 468 is shown as a continuous annular rim corresponding to the continuity of first connector 466, but according to the various alternative embodiments, second connector 468 may also be segmented or provided intermittently. According to an exemplary embodiment, second connector 468 extends upward at an orientation intended to facilitate a hermetic seal with first connector 466. For example, second connector 468 may extend at least partially outward as second connector 468 extends upward. According to an exemplary embodiment, second connector 468 is at least partially deformable (e.g., flexible, elastic, bendable, etc.) for biasing second connector 468 into a hermetically sealed position relative to first connector 466.

According to the embodiment illustrated, the hermetic seal is obtained when container 100 is moved to the closed position. To close container 100, a downward force is supplied to cover 200 to effect a pivot motion of cover 200 toward base 300. In the process of closing container 100, first connector 466 engages second connector 468 causing first connector 466 to partially deform or flex outward. In such a configuration, a hermetic seal is provided between first connector 466 and second connector 468.

According to an exemplary embodiment, the engagement between first connector 466 and second connector 468 may also provide a latching function for container 100 so that cover 200 remains secured to base 300 until a user intends to move container 100 to the open position. According to the various alternative embodiments, the hermetic seal may be provided by any of a number of configurations between cover 200 and base 300.

It is important to note that the construction and arrangement of the elements of the compact container as shown in the exemplary embodiment are illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Further, the compact container may be configured in a wide variety of shapes to accommodate varying design criteria. According to an exemplary embodiment, the compact container has an overall height between approximately 0.5 inches and approximately 2 inches. For such an embodiment, the compact container may have an width (e.g., diameter, etc.) between approximately 2 inches and approximately 3 inches. Limiting the size of the compact container to such dimensions allows the compact to be conveniently carried and/or stowed by the user. According to the various alternative embodiments, the compact container may be configured into other sizes, as well as other well-known or otherwise suitable shapes having linear and/or nonlinear edges and surfaces. For example, the compact container may be a generally rectangular or octagonal container. Accordingly, all such modifications are intended to be included within the scope of the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the appended claims.

What is claimed is:

1. A container for supporting and dispensing a liquid material, the container comprising:

a base defining a cavity configured to support the liquid material, said base including a concave deck surrounding an applicator support member;

an applicator is rotatably supported at said applicator support member for allowing a user to selectively dispense the liquid material from said cavity, said applicator having a first portion and a second portion, said first portion is configured to be exposed to the liquid material when said second portion is exposed to the user; and a cover coupled to said base for covering said applicator, said cover being selectively movable between a closed position and an open position, wherein said applicator is configured to be manipulated by the user in a manner that allows said first portion to become exposed to the user and said second portion to become exposed to the liquid material.

2. The container of claim 1 wherein said applicator support member includes a channel defined between an inner wall and an outer wall, wherein said channel engages said concave deck and said inner wall rotatably engages said applicator.

3. The container of claim 2 wherein said applicator support member is located in a central portion of said concave deck, said central portion being offset downwardly relative to an outer periphery of said concave deck.

4. The container of claim 2 wherein the base is integrally formed with the cover as a one-piece member.

5. The container of claim 2 wherein said applicator support member includes one or more support feet projecting into said cavity.

6. The container of claim 5 further comprising a second retaining member, the second retaining member being coupled to a first retaining member for rotatably supporting the applicator at the base and for securing the first retaining member to the base.

7. The container of claim 1 wherein said applicator is a substantially spherical member rotatably supported at said applicator support member.

8. The container of claim 1 further comprising a hermetic seal between the base and the cover, the hermetic seal being formed between a first projection associated with the cover and a second projection associated with the base.

9. The container of claim 1 wherein the liquid material is loaded into the cavity through an aperture defined by a bottom surface of the base.

10. The container of claim 1 wherein the liquid material is loaded into said cavity through an aperture defined by a top surface of said deck.

11. The container of claim 1 wherein said cover is coupled to said base about a hinge.

12. The container of claim 1 wherein said container is a cosmetic compact configured to support a liquid cosmetic material.

13. The container of claim 12 wherein said cosmetic compact is substantially circular in shape and has a clam-like configuration.

14. A method of manufacturing a container configured to retain a liquid material, the method comprising:

providing a base having a cavity configured to retain the liquid material, said base having a deck defining an aperture through which the liquid material is configured to be dispensed;

supporting an applicator within said aperture so that said applicator can rotate within said aperture while remaining fixed to said base, said applicator being provided for allowing a user to selectively retrieve the liquid material from said cavity; and coupling a cover to said base, said cover being movable between a closed position and an open position relative to said base.

15. The method of claim 14 further comprising providing a hermetic seal between the base and the cover when the cover is in the closed position.

16. A cosmetic compact for retaining a liquid material, the compact comprising:

a base having a cavity configured to retain the liquid material, said cavity being at least partially defined by an upper deck, said deck having a dispensing aperture in communication with said cavity;

a cover pivotally coupled to said base; and an applicator coupled to said deck and supported for rotatable movement within said dispensing aperture, wherein rotation of said applicator is configured to provide for removal of the liquid material from said cavity.

17. The compact of claim 16 wherein said applicator is spherical member.

18. The compact of claim 16 wherein said deck has a contour that extends downwardly and inwardly towards a central region of said deck, said dispensing aperture being provided at said central region.

19. The compact of claim 16 wherein said base includes an end wall, an inner sidewall, and an outer sidewall, said end wall and said inner sidewall cooperate with said deck to define said cavity, said outer sidewall cooperating with said cover to define an outer periphery of said compact.

20. The compact of claim 19 wherein said inner sidewall and said outer sidewall are cylindrical structures that are substantially circular in shape, said inner sidewall being substantially concentric with said outer sidewall.

21. A cosmetic compact comprising:

a cover connected to a base and positionable between an open position and a closed position;

a deck connected to said base and defining a cavity, said cavity retains a material; and an applicator is rotatably supported to said deck by an applicator support member, said applicator support member allows a surface of said applicator to be rotated between a first position outside said cavity and a second position inside said cavity; and said material engages said applicator when said applicator surface is in said second position and said applicator surface is exposed away from said cavity when said applicator surface is in said first position.

* * * * *